United States Patent [19]

Guay

[11] Patent Number: 4,938,137

[45] Date of Patent: Jul. 3, 1990

[54] EXPLODING BRIDGEWIRE DRIVEN MULTIPLE FLYER DETONATOR

[76] Inventor: Roland H. Guay, 7764 Squirehill Ct., Cupertino, Calif. 95014

[21] Appl. No.: 362,629

[22] Filed: Jun. 5, 1989

[51] Int. Cl.[5] ..... F42B 3/12; F42B 3/22

[52] U.S. Cl. ..... 102/202.7; 102/202.9

[58] Field of Search ..... 102/202.7, 202.5, 202.9

[56] References Cited

U.S. PATENT DOCUMENTS

| | | | |
|---|---|---|---|
| 1,598,920 | 9/1926 | Mallet | 102/275.4 |
| 3,134,329 | 5/1964 | Zeman | 102/202.7 |
| 3,264,990 | 8/1966 | Betts | 102/202.7 |
| 3,264,991 | 8/1966 | Betts et al. | 102/202.7 |
| 3,336,452 | 8/1967 | Baker | 102/202.7 |
| 3,978,791 | 9/1976 | Lemley et al. | 102/202.14 |
| 4,089,268 | 5/1978 | Jaroska et al. | 102/208 |
| 4,144,814 | 3/1979 | Day et al. | 102/202.14 |
| 4,291,623 | 9/1981 | Robinson et al. | 102/202.9 |
| 4,312,271 | 1/1982 | Day et al. | 102/202.7 |
| 4,471,697 | 9/1984 | McCormick et al. | 102/202.5 |
| 4,602,565 | 7/1986 | MacDonald et al. | 102/202.7 |

FOREIGN PATENT DOCUMENTS

| | | | |
|---|---|---|---|
| 1120401 | 7/1956 | France | 102/202.5 |

OTHER PUBLICATIONS

John R. Stroud, A New Kind of Detonator [Lawrence Livermore Laboratory], 4/6–7/76, pp. 1–7, FIGS. 1–10.

*Primary Examiner*—Charles T. Jordan
*Assistant Examiner*—Stephen Johnson
*Attorney, Agent, or Firm*—Harold M. Dixon; Robert M. Wohlfarth; Kenneth L. Warsh

[57] ABSTRACT

An apparatus for housing an explosive bridgewire, wherein the explosive bridgewire works in combination with both a multiple flyer disc containing a plurality of flyer elements and a tapered barrel element for directing the flyer elements toward an impact explosive.

18 Claims, 4 Drawing Sheets

EXPLODING BRIDGEWIRE DRIVEN MULTIPLE FLYER DETONATOR

BACKGROUND OF THE INVENTION

1. Field of the Invention

This invention relates to exploding-bridgewires. More particularly, this invention relates to an exploding-bridgewire and an exploding-bridgewire firing set to reliably initiate any explosive. Still more particularly, but without limitation thereto, this invention relates to use of exploding-bridgewire driven multiple flyers to impact and initiate the explosive.

2. Description of the Prior Art

For safety reasons, high voltage exploding-bridgewire detonators are used in ordnance applications. These detonators utilize the heat, shock and energy from an exploding-bridgewire to initiate the surrounding explosive pressed to a closely controlled density at the bridgewire/powder interface. However, use of an exploding-bridgewire to initiate an explosive has been limited to explosives no more insensitive than pentaerythrite tetranitrate (PETN).

Recently, a need has arisen for a more stable, more reliable and a higher temperature explosive than PETN. The major effort has been in the use of the explosive hexanitrostilbene (HNS). To date, the only reliable method of initiating HNS is by an exploding foil concept.

The conventional exploding foil concept of initiating insensitive explosives has been based on dumping sufficient electrical current within a short period of time (burst current) to explode a small and thin metal bridge. The resulting electrically exploded metallic vapor of this flat metal foil bridge is used to shear and drive a flyer disc down a barrel until the flyer disc reaches a maximum velocity Just prior to impacting the explosive (HNS) charge. The flyer disc is normally made from a polyimide resin film or thin sheet. A commercially available resin sold by E.I. du Pont de Nemours & Co., Inc. under the trademark "Kapton" is especially suitable. Upon flyer impact a shock wave of such magnitude is generated that the explosive is detonated.

The single flyer disc provides essentially a point initiation of the HNS charge. The detonation front expands spherically as it travels into the explosive charge. It is a one-shot event thus requiring a maximum current dump to burst the foil bridge to obtain sufficient flyer velocity. The short time and maximum current requires a firing set with an overall low circuit inductance, since a high circuit inductance firing set slows the energy transfer too much. This low circuit inductance requirement makes most standard firing sets used for general exploding-bridgewire initiators unsuitable. Their circuit inductance may be as much as 70–80% too high for reliable exploding foil initiation of insensitive explosives such as HNS.

This invention circumvents the critical energy dump of the single flyer exploding foil concept and the exploding-bridgewire firing-circuit-inductance restraints/limitations by using any standard exploding-bridgewire initiator firing set and the standard bridgewire type detonator construction. Rather than initiating the surrounding explosive directly with the radially exploding-bridgewire as in a conventional exploding-bridgewire device, in this invention the plasma expansion of the exploding-bridgewire is confined and funneled to drive five or more flyers to impact the explosive with sufficient total energy and extended pressure-pulse duration to initiate any explosive, regardless of how insensitive the explosive or explosive mixture is.

SUMMARY OF THE INVENTION

An object of this invention is to provide a means for reliably initiating any explosive.

A further object of the present invention is to provide a means for reliably initiating any insensitive explosive by means of a standard exploding-bridgewire firing set.

It is also an object of the present invention to provide a means whereby a conventional exploding-bridgewire technique can be used to drive multiple flyers to impact the explosive surface simultaneously or in various cascading modes to extend the peak-pressure-pulse duration.

A still further object of the present invention is to provide an inert inventory component whereby the multiple flyer mechanism is incorporated in a steel cartridge which merely needs to be properly attached/secured against any explosive surface when needed.

Another object of the present invention is to provide a means of obtaining a low cost and extremely safe exploding-bridgewire blasting cap device whereby no primary explosive would be used as in conventional blasting caps (which are sensitive to various electrostatic discharges) by combining the inert flyer mechanism with an insensitive explosive of the proper density in a load sleeve placed in a suitable housing. These and other objects have been demonstrated by the present invention wherein exploding-bridgewire driven multiple flyers in a variety of configurations impact a given explosive.

BRIEF DESCRIPTION OF THE DRAWING

The invention will be described in further detail with reference to the accompanying drawings wherein.

DESCRIPTION OF THE PREFERRED EMBODIMENT

Figure 1:
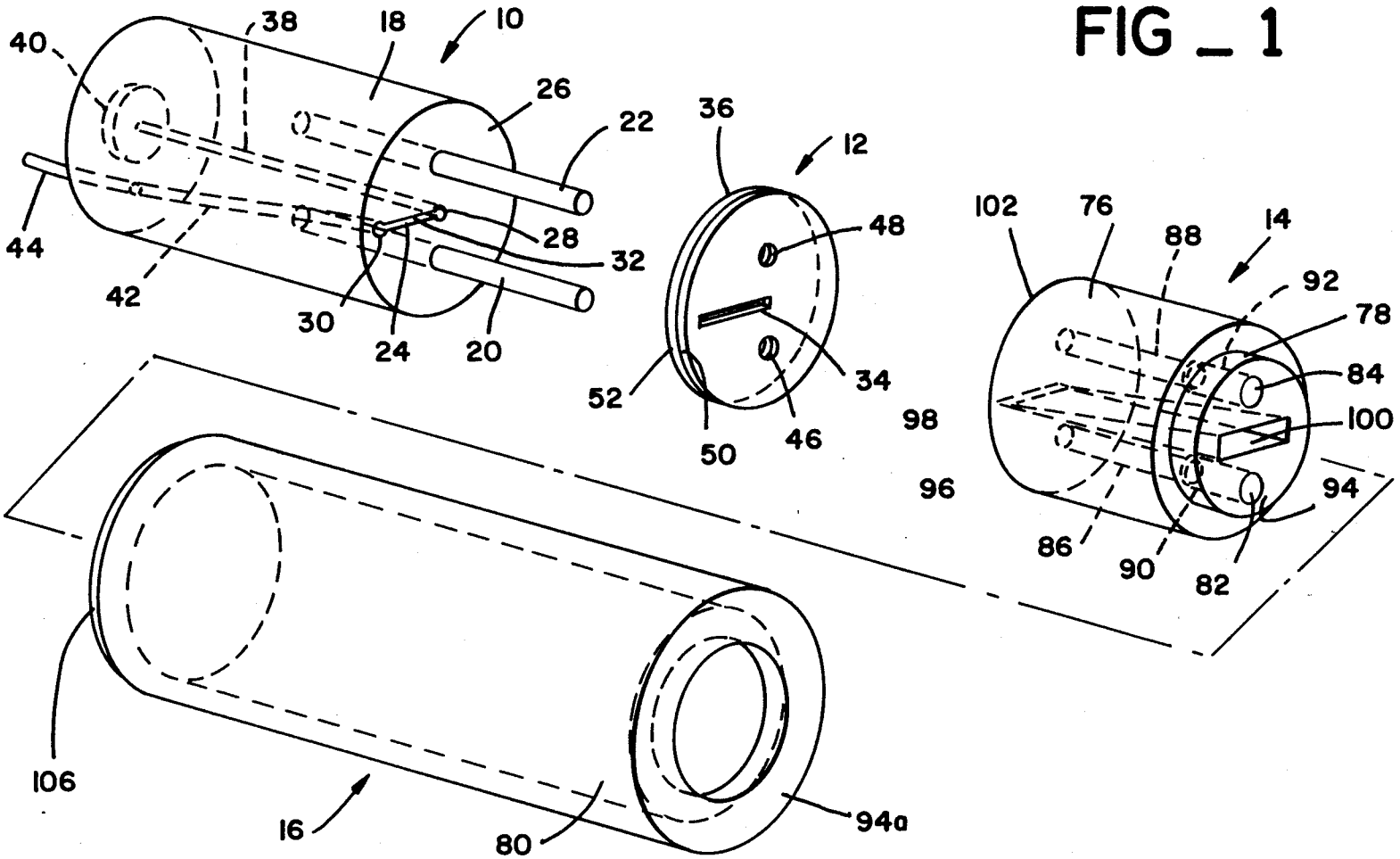
FIG. 1 is an exploded perspective view of the exploding bridgewire driven multiple flyer mechanism.

FIG. 1 provides an exploded view of this invention illustrating the four main components: the header assembly 10, the multiple flyers bridge disc 12, the barrel 14 and the housing 16.

The header assembly 10 is comprised of a cylindrical header 18 having two partially embedded and bonded pins 20 and 22 which are used to permanently align all the components in such a manner as to guarantee proper and fool-proof assembly and therefore reliable initiation of the explosive. The hard header 18 is preferably of a material such as ceramic, glass or synthetic sapphire. The metal pins 20 and 22 are secured in the header 18 by brazing or molding techniques.

Figure 2:
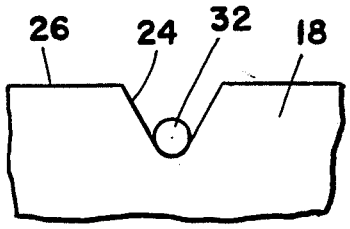
FIG. 2 is an enlarged cross-sectional detail view of the bridgewire in proper position in the channel.

A small offset channel or groove 24 is cut into the hard header surface 26 as is shown in FIG. 2. The groove, cut between the bridgewire terminal welds 28 and 30, can accommodate a bridgewire 32 of circular cross-section or alternately, a bridgeribbon of rectangular cross-section, not shown. The embedded bridgewire or bridgeribbon is preferably of a goldantimony alloy. An alloy sold by J. M. Ney Co. under the trademark "Ney-Oro-G" is especially suitable. The purpose of the channel 24 is to provide confinement for the explosive gases and particles from the exploding-bridgewire and focus these against the bridge. The plasma expansion and reflected shock wave of the exploding bridgewire is through this narrow groove in the substrate, rather than radially into the surrounding explosive, as in a conventional exploding-bridgewire device. Free volume, especially at the ends of the bridgewire welds, is kept to a minimum. The header surface 26 is ground and polished to minimize having any voids at the interface of the multiple flyers bridge disc 12 and the header assembly 10. The presence of voids could adversely reduce the pressure pulse of the exploding-bridgewire. The bridgewire may need to be bonded to the groove with a high temperature material before welding to prevent the bridgewire 32 from forming an arc which would result in varying distances between the bridgewire 32 and the multiple flyers of the flyer bridge 34. FIG. 2 shows a void between the bridgewire 32 and the surface 26 of the header 18. When assembled, the header surface 26 is positioned adjacent to the disc surface 36. In certain applications, this void can be filled flush to the surface 26 of the header 18 with an explosive lacquer slurry loaded with PETN or other non-primary explosive. Filling this void would provide further confinement for the plasma formed by the exploding-bridgewire 32 and the resulting initiation of the explosive slurry would produce more confined gases to drive the flyers 34.

The terminal weld 28 is formed by the junction of the bridgewire 32 and the anode pin 38 which is bonded in or brazed in the header 18 and provided with a suitable interface electrical connector terminal 40, such as a cap or lead. The ground wire 42 is also bonded in the header 18 and forms terminal weld 30 at the junction of its unexposed end with the bridgewire 32. A portion of the ground wire extends some length leaving an exposed end 44, forming a second electrical connector terminal for subsequent welding to the housing 16 to form an inert cartridge.

The multiple flyers bridge disc 12 has two alignment holes 46 and 48 providing a slip fit over pins 20 and 22 respectively, to accurately align the multiple flyers bridge 34 with the bridgewire 32. The disc 12 is a two-layer special construction design made of a metal clad polyester film, i.e. a vapor deposited metal layer 50 on a polyester film layer 52. Particularly good results have been obtained using a film sold by E.I. du Pont de Nemours & Co., Inc. under the trademark "Mylar". The surface 36 of layer 52 will automatically lie in contact with the surface 26 of the header 10 due to the alignment pins location relative to the offset position of the bridgewire 32 and flyer bridge 34. Layer 52 acts to electrically isolate the bridgewire 32 from layer 50 and the metal flyers bridge 34. The metal layer 50 gives rigidity to disc 12 during assembly, assures maintaining alignment (in conjunction with pins 20 and 22) of the flyer bridge 34 with the bridgewire 32, and provides a pre-bonded flyer material which only needs etching to form a flyer bridge in a configuration such as that shown in FIG. 3. For production reliability, a series of flyer bridges may be etched on a copper clad polyester film and each bridge then aligned optically over a master bridge aperture and bridgewire and the holes 46 and 48 punched simultaneously with the required outside diameter of disc 12 to assure accurate placement of the bridge 34 via the pin holes 46 and 48 during assembly.

Figure 3:
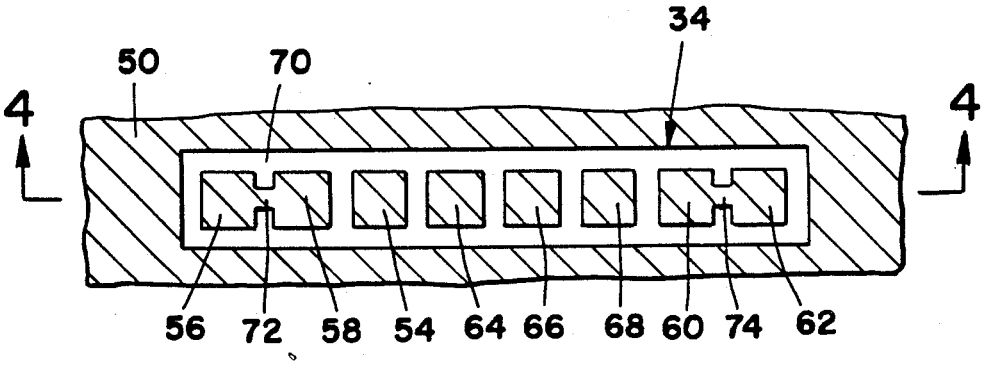
FIG. 3 is an enlarged detail view of a planar multiple flyer bridge.
Figure 4:
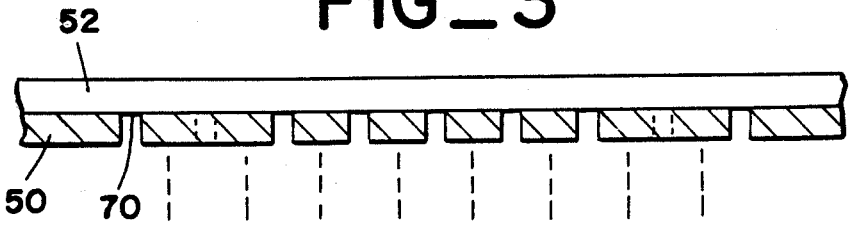
FIG. 4 is a cross-sectional view taken along the line 4—4 of FIG. 3.

A plurality of flyers such as flyer 54 (See FIG. 3) form the bridge 34 on the disc 12 by chemical etching, vapor deposition of copper or by a laser microbeam cutting technique. As many flyers as are necessary to cover the length of the bridgewire 32 between the terminal welds 28 and 30 can be used. For example, without limiting this invention in any manner, eight flyers, each about 5 mils square would cover a bridgewire about 49 mils long. FIG. 3 illustrates a bridge with eight flyers 54, 56, 58, 60, 62, 64, 66 and 68, etched over surface 70. The end flyers 56 and 58, and 60 and 62, are joined by copper webs 72 and 74 respectively. These webs 72 and 74 are optically aligned during assembly, directly over the bridgewire terminal welds 28 and 30, in order to insure that the multiple flyers are coplanar with the bridgewire 32. The scored surface 70 is obtained by selectively removing areas of the metal layer 50 in the desired configurations at a depth no less than the thickness of layer 50. In this manner, the scored surface 70 is the exposed polyester film surface of layer 52. This concept is best illustrated in FIG. 4. Additional scoring, not shown, of the layer 52 around the edges of each flyer will minimize the gas pressure wasted in breaking this layer, thus allowing most of the gas pressure generated by the exploding-bridgewire to be used to gain maximum velocity of the multiple flyers.

The cylindrical barrel 14 has a wide end 76 having the same diameter as the header assembly 10 and disc 12, and a narrow end 78 which fits into the narrow portion 80 of the housing 16. The barrel is made of a hard material, preferably synthetic sapphire or a polyimide resin. Alignment channels 82 and 84 allow for proper assembly with pins 20 and 22. These channels have a narrow portion 86 and 88 which permit a close fit for pins 20 and 22 respectively. When the header assembly 10, disc 12 and barrel 14 are all aligned and in place, the wide portions 90 and 92 of the alignment channels each provide an annulus surrounding the pins 20 and 22, which are of a smaller diameter. These annuluses are filled with a high temperature bonding material to permanently affix the header 10, disc 12 and barrel 14. An additional advantage in the use of the barrel 14 is that there is no contact between the bridgewire 32 and the explosive which is placed adjacent to the narrow end surface 94. This eliminates two ongoing problems of conventional exploding bridgewire devices: material incompatibility which can result in corrosion of the bridgewire and/or crystal growth on the bridgewire and degradation of the explosive in contact with the bridgewire due to repeated bridgewire verification testing.

The most important feature of the barrel 14 is the slot 96 of gradually increasing dimensions, starting with a narrow end 98 of the same dimensions as the multiple flyer bridge 34 and ending with a wide end 100. In operation, the bridgewire explodes due to a high electrical current dumping and causes the flyers to be ejected and set into motion. The slot 96 provides control of the "run distance" which is the distance required by these accelerating flyers to reach a maximum velocity just prior to impacting the explosive. This slot at its narrow end 98, is closely dimensionally controlled and oriented to match the area of surface 70 surrounding the multiple flyers to minimize the pressure pulse decay from the exploding-bridgewire 32. For reliable initiation of any explosive, the wide end 100 must be in contact with the explosive, not shown, to assure the design requirement of the "run distance". The slot 96 dimensions increase towards the explosive to preclude flyer contact with the side walls of slot 96 which would reduce flyer velocity. Flyer tumbling is not likely in the short run distance. The barrel's wide end surface 102 surrounding the narrow end of the slot is ground and polished to provide two necessary features: first, sharp edges for shearing the thin polyester film layer surrounding and supporting the flyer bridge 34, i.e. surface 70 and the underlying portion of layer 52; and second, to avoid having any voids at the interface between the copper metal surface of disc 12 and barrel 14 which could adversely reduce the pressure pulse.

Figure 5:
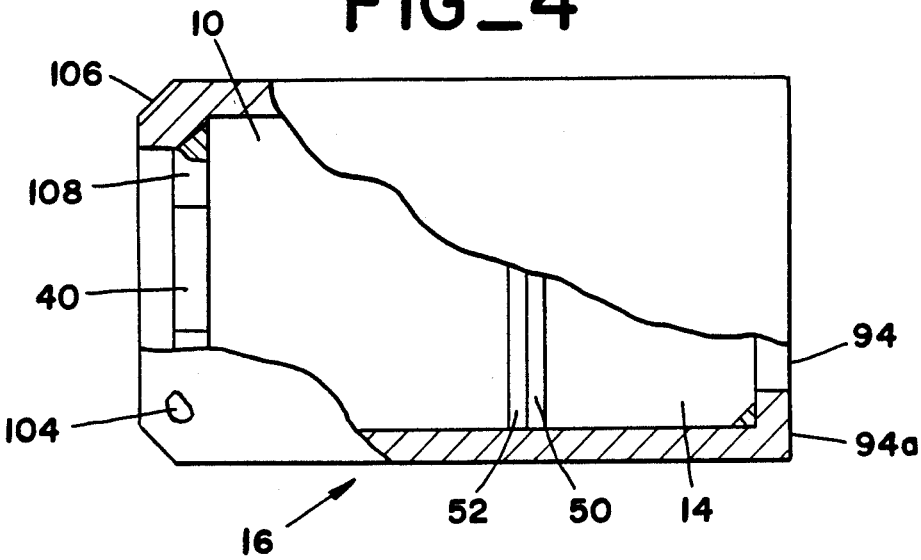
FIG. 5 is a partial cross-sectional view of the assembled steel inert cartridge taken along the longitudinal axis.

After the header 10, disc 12 and barrel 14 are assembled and the bridgewire 32, flyer bridge 34 and slot are optically aligned, the pins 20 and 22 are permanently bonded to the wide portions 90 and 92 of channels 82 and 84 respectively, and a compressive load applied during cure. This will preclude air gaps or channels at the header 10, disc 12 and barrel 14 interfaces, which would contribute to the pressure pulse decay and will facilitate subsequent handling of the assembly components. A tensile load may be applied to the pins 20 and 22 during cure. The ends of pins 20 and 22 may be threaded for the placement of nuts or knurled to assure positive holding. This integral assembly is then encapsulated in the housing 16, preferably made of stainless steel to provide a hermetically sealed enclosure. Surfaces 94 and 94*a*must be flush with each other to provide proper positioning of the surface 94 and the explosive. Moisture sealing is placed in the narrow portion 80 of housing 16. The extended ground wire 44 is then welded to the retainer at one spot 104, as is shown in FIG. 5. Additionally, the housing edge 106 is crimped at a 45 degree angle to further retain the assembled components. The space (formed by the crimp) between the header 10 and the edge of the housing 16 is sealed with a high temperature fillet seal 108. The crimping and sealing assure cartridge integrity and reliabilitY in the event the unit is inadvertently dropped. A protective cap, not shown, can be placed over the output end of the housing 16 on inert cartridges to keep moisture and foreign objects out of the slot 96 and protect surface 94 from damage. This forms an inert initiation cartridge element which can be inventoried for general use or can be placed together with a two-density explosive load-sleeve, such as 1.30–1.40 and 1.60 g/cc hexanitrostilbene, into a suitable casing to which electrical connections are made. Such a unit would essentially be an exploding-bridgewire blasting cap or a general use detonator. A typical standard firing unit suitable for use with this invention should have the following properties:

| | | |
|---|---|---|
| Circuit inductance | 160 | nH |
| Resistance | 24 | mOhm |
| Capacitance | 0.45 | μF |
| Output voltage, min | 2300 | volts |
| Spark gap output voltage, min | 1900 | volts |
| Detonator all-fire, max | 900 | volts |

Simultaneous, maximum impact initiating pressure of all the multiple flyers on the explosive can be achieved if the header surface 26, the disc layers 50 and 52 and barrel wide surface 102 are all parallel to the explosive surface. With this type of configuration, each flyer will impact simultaneously an unreacted area of the explosive and the resulting spherically expanding shock waves from each flyer impact would collide and create the required initiation conditions. Such a parallel design would be the cheapest to produce.

If the parallel flyer explosive surface configuration of FIGS. 1, 3, 4 and 5 does not result in an all-fire of around 900 volts, then a more complex approach can be used. The mechanics of initiating an explosive involves first, ignition of the explosive, i.e., first flash of light and buildup of the reaction to propagation. Initiation, theoretically, is an ignition followed by growth of combustion at the ignited "hot spots". Therefore, the more hot spots formed, the stronger the ignition, buildup and propagation. Initiating an explosive surface can only be accomplished if a number of critical parameters are exceeded such that the explosive will either detonate or not. In order to obtain a minimum All-Fire voltage level the explosive being impacted by flyers must not only be pressed to specific density (1.30 to 1.40 g/cc in the case of HNS) but also the specific surface area of the explosive particles should be in the range of 6 to 8 square meters per gram. This would provide the proper amount of interstitial gases (from trapped air during consolidation, vapors from occluded solvents or absorbed gases/liquids) and consequently the proper amount of hot spots to result in initiation.

To maximize the total effect of a plurality of flyers impacting the explosive, each flyer should impact the explosive surface that has already been shocked and is still in a reactive state from the preceeding flyer impact. The hot spots reach very high temperatures due to the adiabatic compression of the interstitial gases thereby sustaining chemical reaction of the explosive. Thus a sustained stepwise increase in impact pressure could eventually result in a detonation.

To achieve sustained stepwise increases in impact pressure, the principles of this invention can be applied to provide a cascading type of impact pressure increase by designing a sloped bridge, i.e. the header assembly, disc and barrel interfaces are sloped relative to the explosive surface. This is illustrated schematically in FIGS. 6 and 7. The header assembly 110, multiple flyers bridge disc 112 and barrel 114 are all identical in construction to those of FIG. 1, the only exception being the sloped interfaces. The assembled unit is then placed in a housing identical to the housing of FIG. 1, the ground wire 116 welded, the housing edge crimped and the resulting space sealed. Alternately, only the bridge portion of disc 12 need be sloped at the design angle. The interfaces could be perpendicular to the cartridge axis as long as no voids are incurred which could cause a decay in the pressure pulse. However, a sloped interface is the preferred embodiment as it would provide visual and x-ray/n-ray evidence as to the configuration of the bridge in any cartridge.

Figure 6:
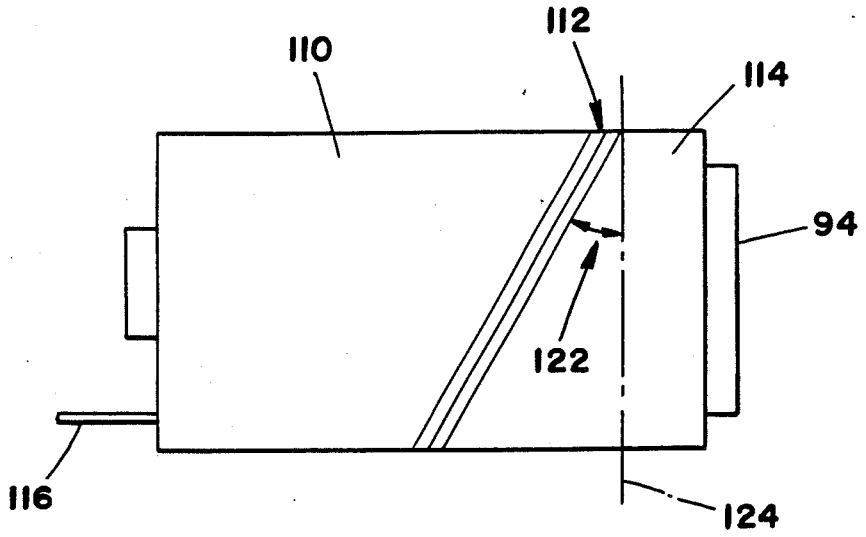
FIG. 6 is a simplified schematic of the sloped bridge inert cartridge design.
Figure 7:
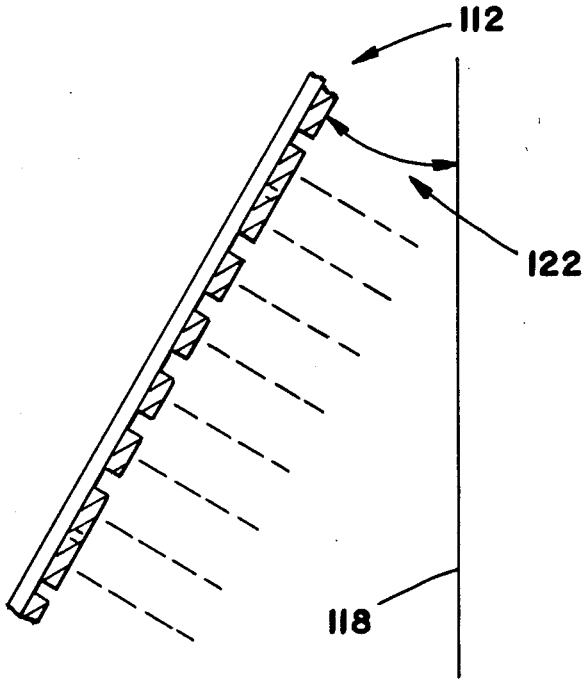
FIG. 7 is an enlarged detail view of the sloped exploding-bridgewire embodiment.

The sloped bridge design of FIGS. 6 and 7 provides a controlled delay in impact-arrival-time for each flyer reaching the explosive surface 118, which lies in contact with the barrel surface 94. The dashed lines shown on FIG. 7 represent the path traveled by the flyers. The slope angle 122 taken from datum line 124, is a function of numerous factors including flyer thickness, velocity desired at impact, and pulse duration required, in order to provide the minimum all-fire voltage. For example, for an eight flyer bridge design as is shown in FIG. 7, the minimum slope angle 122 is about 24 degrees for an insensitive explosive such as HNS having a shock pulse decay plateau around 60 nanoseconds after impact. More sensitive explosives than HNS would require a lesser slope angle. However, a 24 degree angle would cover all explosives more sensitive than HNS.

Figure 8:
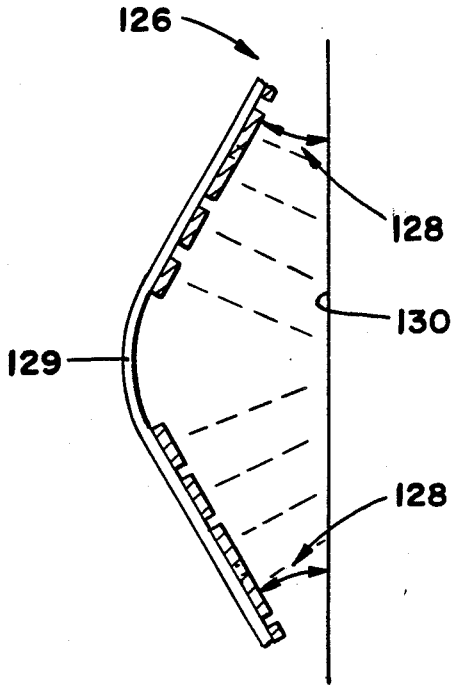
FIG. 8 is an enlarged detail view of the concave exploding-bridgewire embodiment.

FIG. 8 illustrates an embodiment suitable for explosives more insensitive than HNS, utilizing a compound sloped bridge design employing for example, 16 flyers driven by one exploding-bridgewire about, 0.125" long arranged on a metal clad polyester film 126 having two eight flyer coplanar bridges each sloped at an angle 128 about 30 degrees relative to the explosive surface 130 and at an obtuse angle 129 about 120 degrees from each other. This design allows for concentration of the reaction zone peaks in the explosive, at some point midway between the bridges. Such a collision of two powerful advancing shock waves would create such high stress as to initiate practically any explosive, even the most insensitive one.

Figure 9:
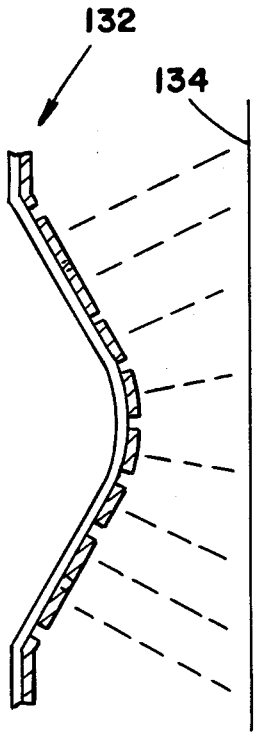
FIG. 9 is an enlarged detail view of the convex exploding-bridgewire embodiment.

In cases where only half of the flyers (for example 4 out of 8) are required to reliably initiate a particular explosive, the bridge may be configured in a symmetrical convex contour relative to the explosive surface, to provide staggered impacts in both directions from the center impact point with the explosive surface. This is shown in FIG. 9 where the multiple flyer bridge 132 is convex relative to the explosive surface 134. In this alternate embodiment, the central flyers act to provide normal initiation of the explosive and the outlying flyer-scan bedirected away from the central area of the explosive charge to areas where ignition conditions may be more favorable due to particle size or density. Further, initiation is reinforced by the outlying flyer impacts to accommodate any anomalies at the explosive surface.

Figure 10:
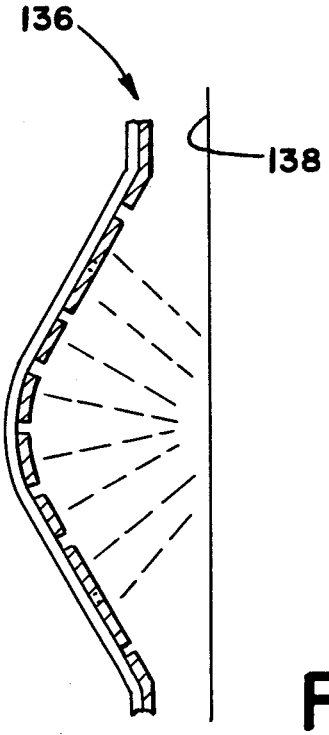
FIG. 10 is an enlarged detail view of the concave exploding-bridgewire embodiment.

Likewise, as is shown in FIG. 10, the bridgewire/-flyer/barrel interfaces 136, along with the header and barrel surfaces adjacent to said metal clad polyester film bridge, can be configured in a symmetrical concave contour relative to the explosive surface 138 so that the impact pressure from all the flyers is focused on a relatively small area of the explosive surface. This embodiment provides a slightly delayed impact arrival time for each flyer. However, all of the flyers would impact the same surface area of the explosive, creating a single point stress area of such magnitude resulting in a maximum initiation pressure which will cause detonation. Such a multiple flyer focusing design would be especially useful for end initiation of a low core load linear explosive, eg. a 2–3 grains per foot mild detonating fuse(NDF). Current technology must use an overkill approach for the initiating unit since only a fraction of its output actually impacts the small cross-sectional area of the explosive column of the MDF. This overkill condition necessitates large and substantial (heavy) initiating fittings especially in missile applications where shrapnel and other solid particles must be confined.

It has been verified that hexanitrostilbene (HNS) can be reliably initiated by a single flyer exploding foil initiator. This establishes a kinetic energy level equal to $\frac{1}{2}(m_1v_1^2)$. Likewise, the kinetic energy level of the multiple flyer initiator is equal to $\frac{1}{2}(m_2v_2^2)$. Then kinetic energy sufficient to initiate an HNS charge of known density and specific surface area from a single exploding foil should be the same as that required from the multiple flyer. Therefore, by accepting a lower velocity $v_2$ for the exploding bridgewire driven flyers which have a higher mass $m_2$, then this would be equivalent to the higher velocity vI of the single flyer disc of the exploding foil device which has a much lower mass mI (Kapton flyer) than the copper flyers' mass $m_2$ of the multiple flyer concept of this invention.

However, there is a synergistic aspect beyond mere kinetic energy equivalency and that is the repeated sustained stepwise build-up or conservation of energy realized by the staggered flyer impacts before pressure pulse decay has progressed too much. The critical impact initiating pressure for an explosive has been defined as the "von Neuman (vN) spike pressure", and the critical initiating pressure pulse as that between the vN and Chapman-Jouget (CJ) planes of the detonation front. These two planes are separated by a distance, the growth-to-detonation distance and a time, the reaction time or pulse duration. To maximize the total impact effect of the multiple flyer concept of this embodiment, each flyer should impact the explosive surface that has already been shocked and is still in a reactive state from the preceeding flyer impact. Therefore, a sloped bridge design as described herein, would provide a controlled delay impact arrival time for each succeeding flyer thus providing a repeated and sustained impact pressure. For example, for an HNS explosive of a given specific surface area and density, each succeeding flyer should impact the explosive surface no later than 60 nanoseconds after the previous flyer impact in order to achieve a maximum total impact pressure from a multiple flYer design. A minimum slope 122 of about 24 degrees for a multiple flyer bridge as shown in FIG. 7 would operate effectively within the 60 nanosecond parameter.

The foregoing description has been set forth merely to illustrate the invention and is not intended to be limiting since modifications of the described embodiments incorporating the spirit and substance of the invention may occur to persons skilled in the art, the scope of the invention should be limited solely with respect to the appended claims and equivalents.

What is claimed and desired to be secured by Letters Patent of the U.S. is:

1. Apparatus for initiating an explosive comprising:

(a) a bridgewire;

(b) a header assembly means for supporting said bridgewire, said means for supporting said bridgewire having a first surface with a channel in which said bridgewire is disposed;

(c) electrically conductive means coupled to each of the respective ends of said bridgewire for applying an initiating electrical current across the channel confined bridgewire to explode said bridgewire, thereby producing channel confined explosive gases and particles;

(d) a multiple flyers bridge disc having a first layer of electrical insulator adjacent to said first header assembly, a second layer of metal cladding on said electrical insulator layer and having a bridge comprised of a plurality of flyers aligned with said bridgewire, said bridge being disposed over said bridgewire in a path of said explosive gases and particles, from said bridgewire when exploded, said explosive gases and particles ejecting said plurality of flyers from said multiple flyers bridge disc; and (e) means for directing said ejected plurality of flyers away from said disc and said header assembly, (f) means for directing said ejected flyers to impact an explosive which includes a barrel having a first surface disposed adjacent to said bridge disc having an internal longitudinal slot of gradually increasing cross-section and thereby said slot has a small end and a large end, said slot having the same cross-sectional dimensions as said bridge at the smaller end, said slot being disposed over and aligned with said bridge so that said plurality of flyers are directed toward an explosive which is disposed to have a face aligned with a second surface of said barrel, said slot providing a controlled run distance for said plurality of flyers toward said explosive.

2. Apparatus as recited in claim 1 wherein (a) said first layer of said multiple flyers bridge disc comprises a layer of polyester film;

(b) said second layer of said multiple flyers bridge disc comprises a layer of metal disposed on said first layer; and (c) said bridge is formed by removing part of said second layer to provide said plurality of flyers.

3. Apparatus as recited in claim 2 wherein said second layer is a layer of copper bonded on said first layer.

4. Apparatus as recited in claim 2 wherein said electrically conductive means is disposed to connect to said bridgewire from said first surface side of said header assembly.

5. Apparatus as recited in claim 1 wherein (a) said first layer of said multiple flyers bridge disc comprises a layer of polyester film;

(b) said second layer and said bridge are formed by vapor deposition of metal on said first layer.

6. Apparatus as recited in claim 1 further including means for aligning said bridgewire, said bridge and said slot of said barrel.

7. Apparatus as recited in claim 6 wherein said means for aligning comprises:

(a) two pins anchored in said first surface of said means for supporting said bridgewire, said two pins extending outward from said first surface and through said multiple flyers bridge disc and said barrel;

(b) said multiple flyers bridge disc having alignment holes for receiving said two pins; and (c) said barrel having two alignment channels for receiving said two pins.

8. Apparatus as recited in claim 7 wherein said electrically conductive means are coupled to two terminals at a second surface of said means for supporting said bridgewire.

9. Apparatus as recited in claim 7 wherein said two pins are bonded in said two alignment channels to fix said means for supporting said bridgewire, said multiple flyers bridge disc, and said barrel together, thereby forming an integral assembly.

10. Apparatus as recited in claim 9 further including a housing for encapsulating said integral assembly.

11. Apparatus as recited in claim 10 wherein said barrel has a narrow portion at its end where said slot is larger and said housing has a narrow portion adapted to receive the narrow portion of said barrel.

12. Apparatus as recited in claim 10 wherein said housing is metal and one of said two terminals at said second surface of said means for supporting said bridgewire is coupled to said housing to form an inert initiation cartridge.

13. Apparatus as recited in claim 1 wherein the first surface of said means for supporting said bridgewire, said bridgewire, said layers of said multiple flyers bridge disc, and said first surface of said barrel are aligned parallel to each other.

14. Apparatus as recited in claim 1 wherein said first surface of said means for supporting said bridgewire, said bridgewire, said layers of said multiple flyers bridge disc, are aligned sloped relative to said first surface of said barrel, whereby a controlled delay in the impact-arrival-time for each of the flyers is provided.

15. Apparatus as recited in claim 1 wherein said first surface of said means for supporting said bridgewire, said bridgewire, said layers of said multiple flyers bridge disc, are aligned in a symmetrically concave but parallel relationship to said first surface of said barrel.

16. Apparatus as recited in claim 1 wherein said first surface of said means for supporting said bridgewire, said bridgewire, said layers of said multiple flyers bridge disc, are aligned in a symmetrically convex but parallel relationship to said first surface of said barrel.

17. Apparatus as recited in claim 16 wherein said obtuse angle is approximately 120 degrees.

18. Apparatus as recited in claim 1 wherein (a) said first surface of said means for supporting said bridgewire, said bridgewire, said layers of said multiple flyers bridge disc, are aligned in a symmetrically concave but parallel relationship to said first surface of said barrel; and (b) said multiple flyers bridge disc comprises a compound flyers bridge system comprising two multiple flyers bridges slopted towards each other forming an obtuse angle between said two multiple flyers bridges.

* * * * *

UNITED STATES PATENT AND TRADEMARK OFFICE

CERTIFICATE OF CORRECTION

PATENT NO. : 4,938,137

DATED : July 3, 1990

INVENTOR(S) : Roland H. Guay

It is certified that error appears in the above-identified patent and that said Letters Patent is hereby corrected as shown below:

at col. 1 before "BACKGROUND OF THE INVENTION" insert:

STATEMENT OF GOVERNMENTAL INTEREST

The government of the United States of America has rights in this invention.

Signed and Sealed this

Eleventh Day of May, 1993

*Attest:*

Michael K. Kirk

MICHAEL K. KIRK

*Attesting Officer*

*Acting Commissioner of Patents and Trademarks*